US005197150A

United States Patent [19]

Bedient

[11] Patent Number: 5,197,150

[45] Date of Patent: Mar. 30, 1993

[54] VISOR CAP WITH RETRACTABLE PROTECTIVE VISOR AND METHOD OF CONSTRUCTION THEREFORE

[76] Inventor: Jack Bedient, 2217 E. Tudor #19, Anchorage, Ak. 99507

[21] Appl. No.: 829,436

[22] Filed: Feb. 3, 1992

[51] Int. Cl.[5] ..... A42B 1/02

[52] U.S. Cl. ..... 2/195; 2/209.1; 2/10; 2/196; 2/177; 2/185 R; 2/191; 2/199

[58] Field of Search ..... 2/175, 209.1, 10, 196, 2/177, 185 R, 191, 199

[56] References Cited

U.S. PATENT DOCUMENTS

| | | | |
|---|---|---|---|
| 566,326 | 8/1896 | Kirshner | 2/195 |
| 716,258 | 12/1902 | Maass | 2/195 |
| 1,610,745 | 12/1926 | Castanaro | 2/10 |
| 2,004,471 | 6/1935 | David | 2/10 |
| 4,793,006 | 12/1988 | Dawson | 2/195 |
| 5,075,898 | 12/1991 | Bedient | 2/195 |

*Primary Examiner*—Andrew M. Falik
*Assistant Examiner*—Gloria Hale
*Attorney, Agent, or Firm*—Michael J. Tavella

[57] ABSTRACT

A cap with a movable brim and a method of construction for it is disclosed. The movable brim is fitted with a pair of ears, that engage rivets or stitches placed through an upper and lower brim, which are placed around the movable brim. The upper and lower brims are fastened together at their ends with a single row of stitches. The front of the brims is not closed, to permit removal of the movable brim. The ears contact the rivets or the stitches as the brim is extended, thereby preventing the movable brim from being removed. A method of construction using a jig to hold the brims prior to sewing is also disclosed.

13 Claims, 5 Drawing Sheets

VISOR CAP WITH RETRACTABLE PROTECTIVE VISOR AND METHOD OF CONSTRUCTION THEREFORE

This invention relates to visor caps having retractable protective visors.

BACKGROUND OF THE INVENTION

For many years, people have been wearing visor caps. These caps typically have a semi-spherical shell that fits over the wearer's head, and a visor or bill that extends perpendicular from the bottom of the shell. Also, sun visors, which consist of a hard visor and a small, curved frame are now becoming popular. The sun visors provide protection for the face and eyes from the sun without completely covering the head. Typically, the visor is worn over the face to shield the eyes from the sun and weather during golf, tennis and other outdoor activities.

While a normal visor provides adequate protection against the described elements, there are times when the vision of a person may be blocked by the visor, such as when one is working on objects that are overhead. Similarly, in narrow corridors or tight quarters, the standard length visor may strike the walls or other protruding objects. One solution has been to make the visor in two pieces: a fixed portion, usually attached to the shell, and a movable or extendible portion that is secured within the fixed visor so that the extendible visor can be pulled out when needed and pushed in when not.

Examples of some solutions to this problem are illustrated in U.S. Pat. Nos. 1,610,745 to Castanaro, 1,224,471 to David, 4,793,006 to Dawson, 756,258 to Maass and 566,326 to Kirshner.

The problem with all of these designs is that they require seemingly simple, but actually complex construction to enable them to work. For example, the Castanaro Patent teaches a slidable brim that is friction fit within a pocket. The inner end of the slidable brim is secured inside the pocket by three strings, which are secured to the brim. These strings prevent the brim from being completely removed from the pocket. Fastening the strings would be difficult in mass production. The David Patent uses a number of snaps to secure the brim to the top of the hat. In this case, the hat is of a cap style. Two sets of snaps are provided, which allow the brim to be kept in a retracted position in one case, or an extended position, using the other set of snaps. Maass teaches use of pins and slots that permit the brim to be extended. Dawson teaches use of an elastic band to hold the retractable brim, which has two large flanges that hold the brim in place against the elastic band. Kirshner uses snaps and elastic bands to secure the visor to the hat (another cap style that uses a snap to hold the crown of the cap down).

All of these designs require the use of snaps, bands or other such techniques to secure the movable brim in place, either in the extended position or in the retracted position. The instant invention dispenses with the need for all of these fasteners and restraint.

BRIEF DESCRIPTION OF THE INVENTION

The instant invention uses a baseball style cap or a cloth covered, sewn sports visor, in one embodiment, and an injection molded plastic "clip on" type visor in another embodiment. Both embodiments have a retractable brim. The brim is made of three parts: the upper brim, the lower brim, and the movable brim. The movable brim is similar in size and shape to the other brims except that it is slightly smaller, to fit between the upper and lower brims. The movable brim also has two ear portions, placed at opposite sides of the rear portion of the brim.

The upper and lower brims are stitched together at the sides and back, but not at the front. This forms a pocket in which the movable brim can be placed. The movable brim is then placed into the pocket thus formed. Two additional lines of lock stitches are then placed through the upper and lower brims. These lock stitches are designed to form a catch for the ears formed on the movable brim. Thus, when the movable brim is removed from the pocket, it can be extended until the ears contact the lock stitches, which prevent any further outward movement. An alternative to the stitches are rivets placed in a like manner as the lock stitches. Use of rivets can be a labor saving method.

The brim can be constructed by placing the ends into a jig which is angled to hold the brim in place. The jig positions the brim for proper sewing and can also be used with the rivet method.

In the case of the cap, the visor assembly is attached to the cap shell by a line of stitches formed along the edge of the visor. Often a small amount of excess cloth that is used to cover the visor is provided to enable the stitches to hold the visor securely.

In the case of the cloth covered sun visor, the visor assembly is attached to a padded sleeve of cloth. A plastic frame is then placed into the sleeve. The frame is curved to the desired curve for the head. The frame is made of a flexible material to permit the frame to be pulled open and then relax back into its former shape to securely hold the visor on the head. The visor assembly itself can be stitched or riveted to the cloth sleeve.

Finally, in the case of the plastic, injection molded sun visor, the visor is formed in one molding. It has two fixed brims formed at that time. A gap is provided for the movable brim. Two small plugs are also molded into the gap to catch the ears on the movable brim. A slit is provided at the crown piece of the sun visor. This slit provides an opening to insert the movable brim into the gap between the two fixed brims. Once the movable brim is inserted into the gap, the slit can be sealed with a padded adhesive strip.

DETAILED DESCRIPTION OF THE PREFERRED EMBODIMENT

Figure 1:
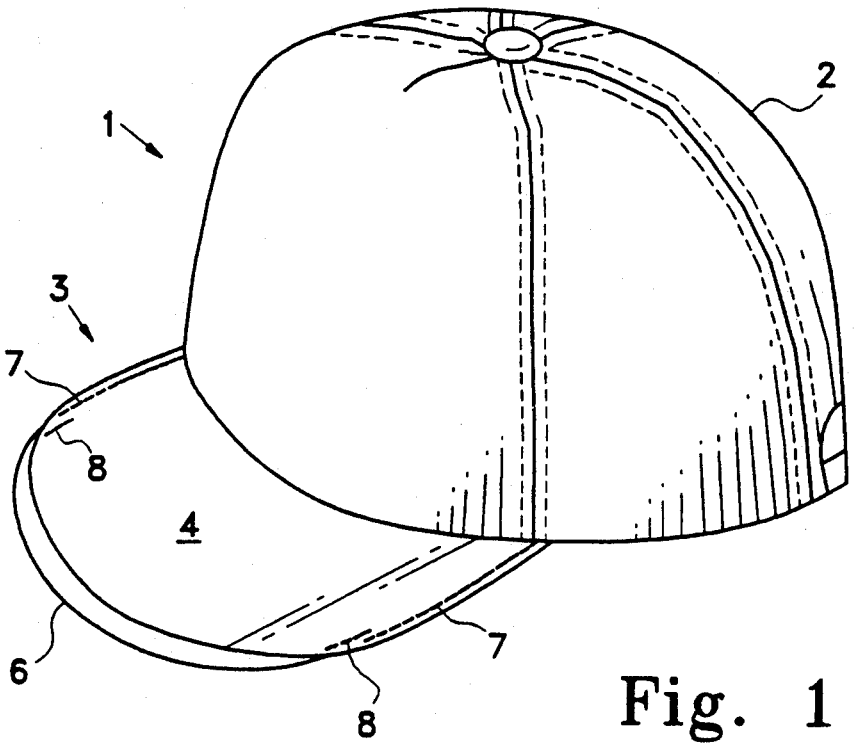
FIG. 1 is a perspective view of the invention with the movable visor retracted.
Figure 2:
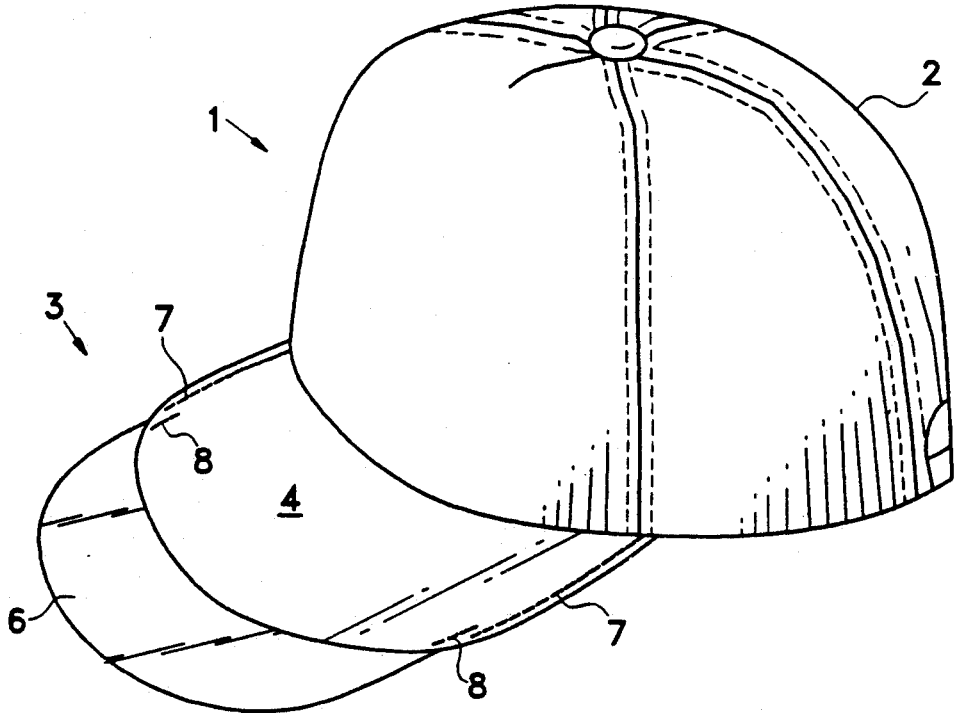
FIG. 2 is a perspective view of the invention with the movable visor extended.
Figure 3:
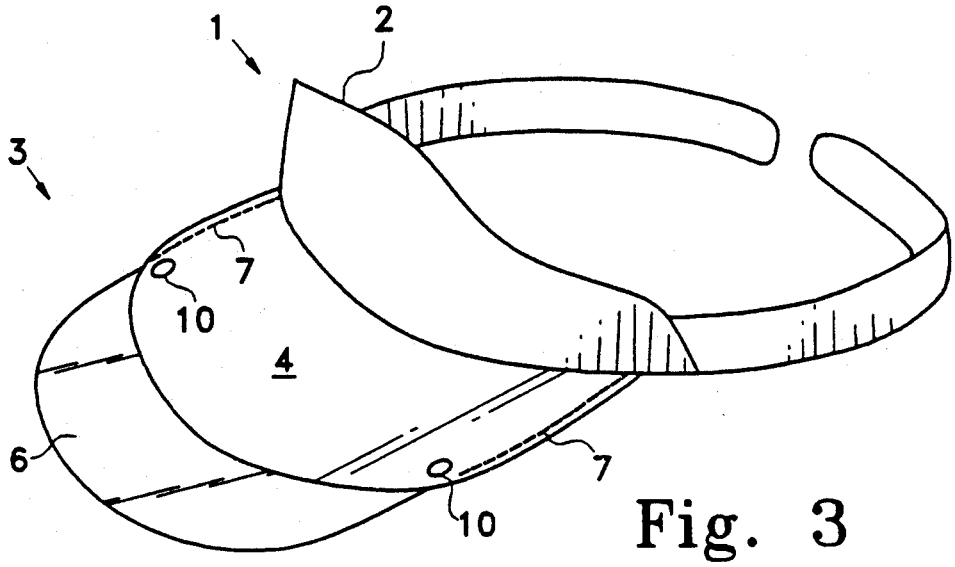
FIG. 3 is a perspective view of a second embodiment of the invention, showing the use of the rivets as locking means.

Referring now to the drawings and particularly to FIGS. 1 and 2, the invention consists of an extendible brim. FIGS. 1 and 2 show a baseball style cap 1, however, the invention can be attached to any style of hat using a curved bill. For example, FIG. 3 shows a visor using tie scarves. Obviously any other type of visor, such as a "clip on" type, which uses an injection molded plastic frame 70 to secure the visor to the head, can also be used. The cap 1 has a crown 2. As just mentioned, the crown 2 can be any style. For illustration purposes, a baseball style cap and visor are shown.

Figure 5:
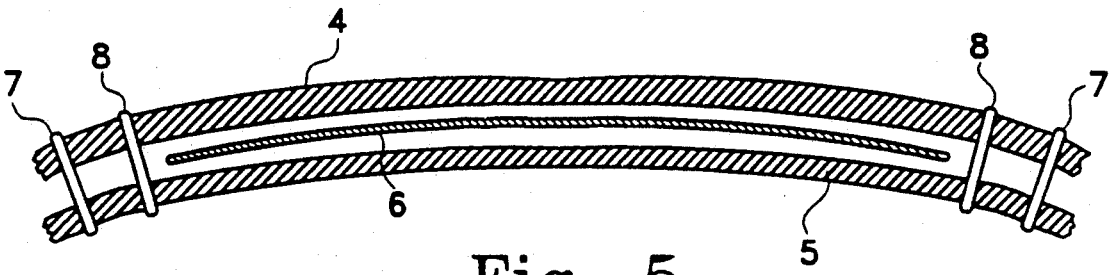
FIG. 5 is an enlarged view of the front of the brim assembly, showing the use of the lock stitches.

The brim assembly 3 is attached to the crown 2 using standard methods known in art. The brim assembly 3 has three parts: an upper brim 4, a lower brim 5 (see FIG. 5), and a movable brim 6. The movable brim 6 is placed between the upper and lower brims as shown in FIG. 5. FIGS. 1 and 2 also show the placement of the movable brim 6 with respect to the hat overall.

The upper brim 4 and lower brim 5 are identical in appearance. The lower brim 5 is ⅛ inch smaller in overall dimension than the upper brim 4, so that when the two brims are sewn together a natural curve exists (see FIG. 6). The movable brim 6 is slightly smaller than the upper and lower brim, to permit the movable brim 6 to fit inside the pocket formed by the upper brim 4 and the lower brim 5.

To form the pocket, the upper brim and lower brim are sewn together as shown in FIG. 5. The outer row of stitches 7 is used to secure the upper brim 4 to the lower brim 5. The stitching is not run along the front of the brim assembly 3, to permit the movable brim 6 to be removed.

Figure 6:
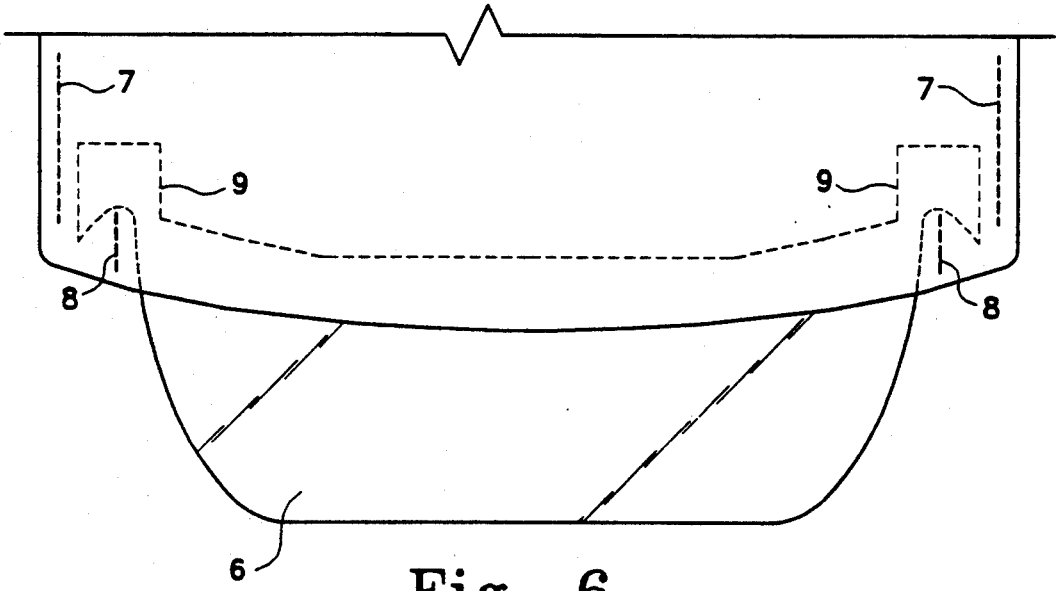
FIG. 6 is a top view of the upper brim, showing the movable visor extended and showing the use of the lock stitches.

Referring now to FIGS. 5 and 6, two lock stitches 8 can be placed into the upper and lower brims as shown. These lock stitches are used to catch and hold a pair of ears 9 that are formed on the ends of the movable brim 6 as shown.

Figure 4:
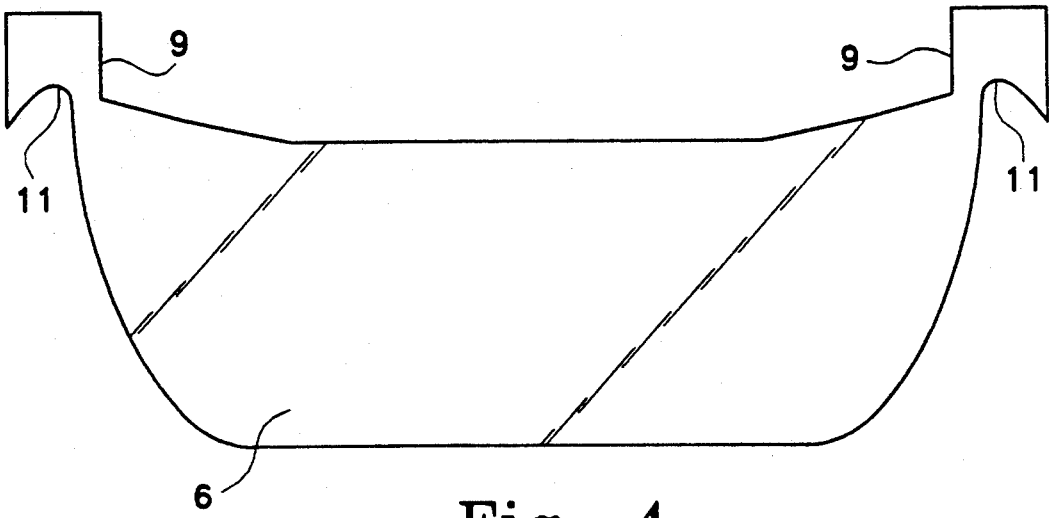
FIG. 4 is a top view of the movable visor.
Figure 7:
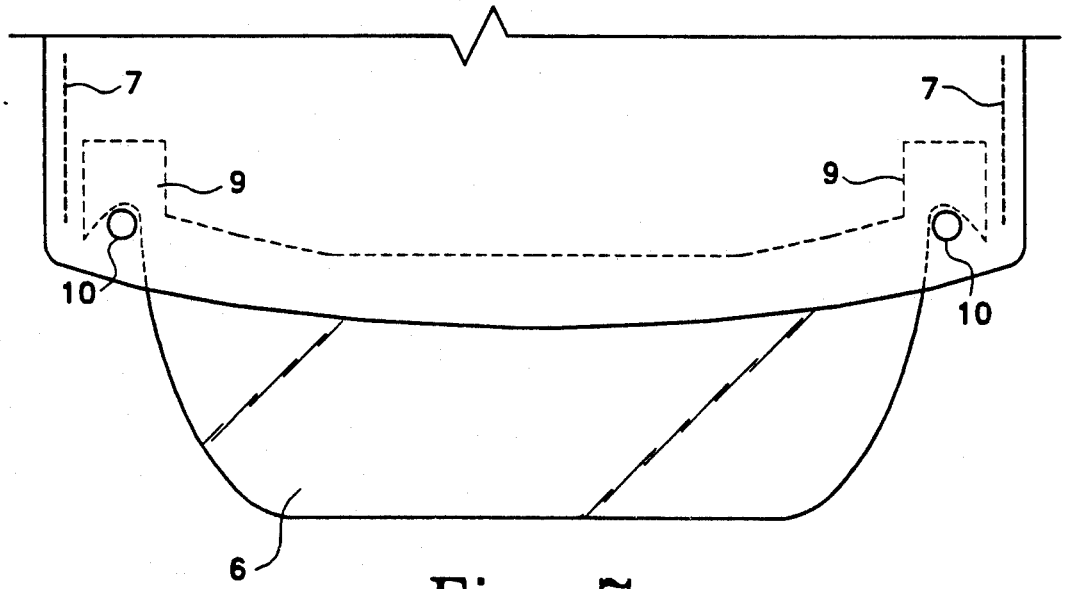
FIG. 7 is a top view of the upper brim, showing the movable visor extended and showing the use of the rivets.
Figure 8:
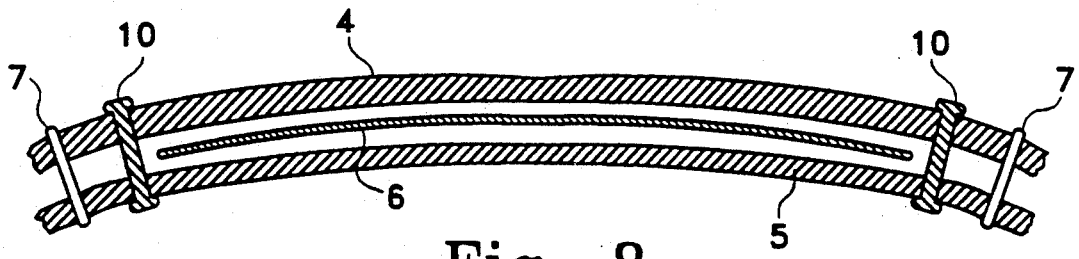
FIG. 8 is an enlarged view of the front of the brim assembly, showing the use of the rivets.

In the preferred embodiment, two rivets 10 are placed into the upper and lower brims, as shown in FIGS. 7 and 8. As shown in FIG. 4, the ears 9 are curved at point 11. This curve allows the movable brim 6 to fit comfortably against the rivets 10 when the movable visor is fully extended The lock stitches and rivets are used to restrain the movable brim 6 from being completely removed by the user.

Figure 9:
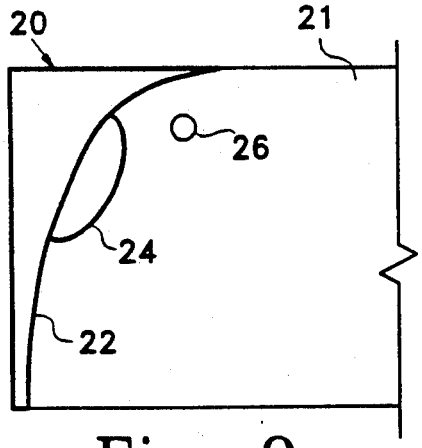
FIG. 9 is a detail view of the assembly jig.
Figure 11:
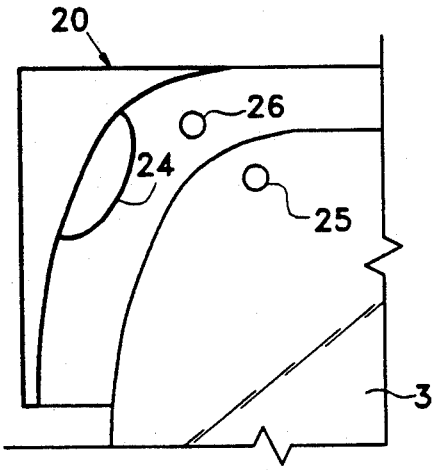
FIG. 11 is a detail view showing the brim being placed into the jig.
Figure 12:
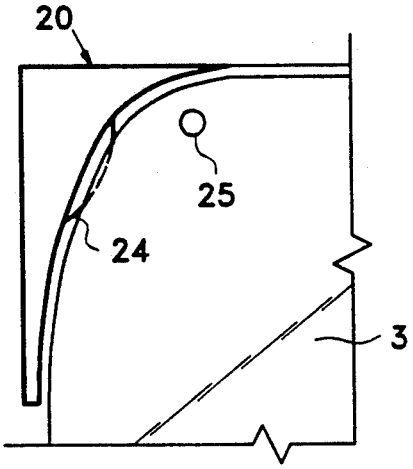
FIG. 12 is a detail of the jig showing the brim in place for operation.

The chief advantage of this design is simplicity of construction. As discussed below, the construction of the brim assembly 3 can be facilitated by use of a jig 20 that is used to hold the cap at the proper angle. Referring now to FIGS. 9, 11, and 12, the jig 20 has a base plate 21 and a curved support frame 22. The curved support frame 22 is raised above the frame so that the brim assembly 3 can be pressed against it in the operative position and then be secured against further movement. The curve of the jig is designed to match the curve of the brim assembly 3. As discussed below, the brim assembly consists of the lower, movable and upper brims, placed in their operative orientation, with the movable brim being in the fully retracted position.

Figure 10:
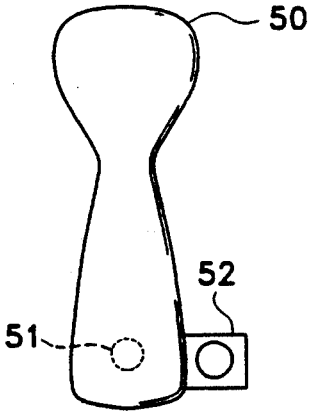
FIG. 10 is a detail view of the top of the sewing machine head with the riveter attachment.
Figure 13:
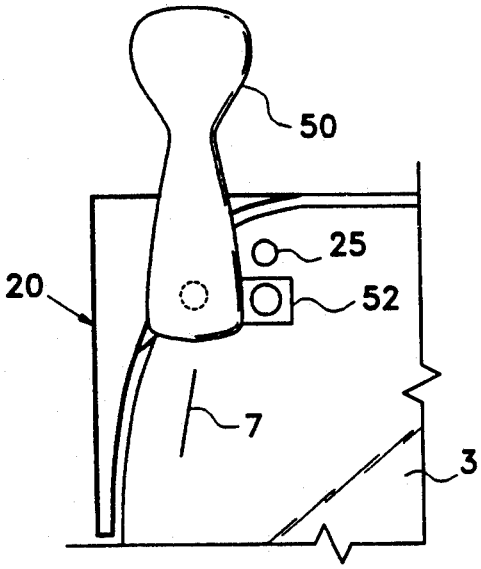
FIG. 13 is a detail of the jig showing the placement of the sewing machine head having just made a stitch and being positioned to secure a rivet.

Referring now to FIGS. 10 and 13, a sewing machine head 50 has a standard needle assembly 51. It is also fitted with a rivet gun 52 such that the sewing machine head 50 can be used to stitch the brims together and drive a rivet through the brim all in one operation, when used in conjunction with the jig 20.

The brim assembly 3 is pre-punched with a hole 25 on each end for the rivets. The hole 25 will align with the rivet peener 26 in the base plate of the jig.

When the brim assembly 3 is placed into proper position, it compresses a tension spring 24, which causes the sewing machine operation, as discussed below, to commence.

The operation is as follows: The upper, movable and lower brims are placed in proper orientation, with the movable brim in the fully retracted position. A rivet hole is placed through the upper and lower brims. In one embodiment, a rivet is then place into the hole. This assembly is then placed against the jig, as shown in FIGS. 11, 12 and 13, and a line of stitches is then made through the upper and lower brims and the rivet is peened. The brim assembly can then be flipped and the other side placed into the jig, where the sewing and riveting operations are repeated.

Alternatively, the rivet can be initially placed into the brims and peened during the sewing operation.

Once the brim assembly has been sewn, the entire assembly than then be attached to the crown and the cap be finished. In attaching the brim assembly to the crown in the preferred embodiment, a slight curve in the brim is desired. The curve of the brim is aesthetical pleasing and tends to offer a bit more shade than a flat brim.

Figure 14:
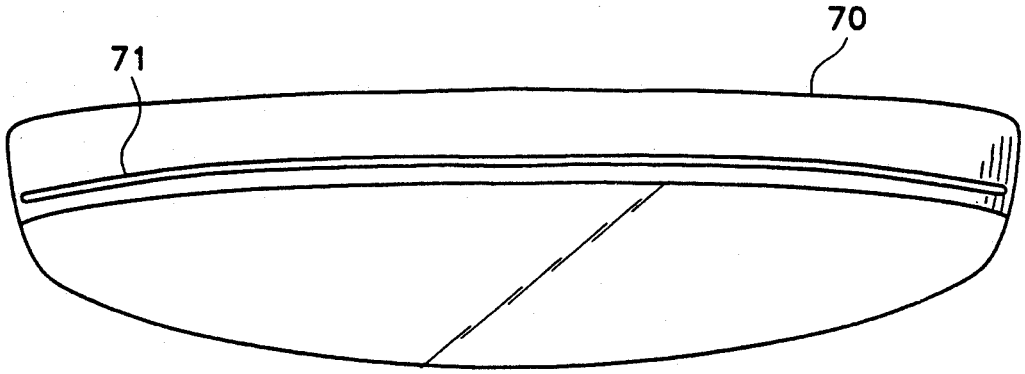
FIG. 14 is a detail of the crown of the injection molded sun visor showing the slit.
Figure 15:
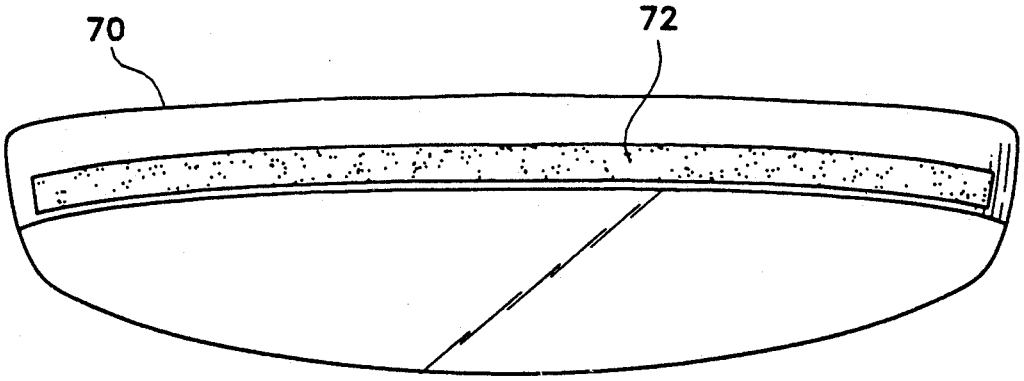
FIG. 15 is a detail of the crown of the injection molded sun visor showing the slit being covered by a padded adhesive strip.

Referring now to FIGS. 14 and 15, the movable brims can be built into an injection molded sun visor 70. This visor is commonly known as a "clip on" type visor because the visor is simply slipped on to the user's head. Spring tension in the extended members of the visor hold the visor tightly against the user's head. The entire sun visor can be injection molded. There are two main differences between the ordinary clip on type visor and the instant invention. First, two fixed brims are formed, with a gap between them. This structure is similar to that of FIG. 1 except that the fixed brim is formed from one molded construction. At the time the gap is formed, two plugs that correspond to the rivets in the sewn cap, are formed to hold the movable brim in place. The second difference is the formation of a small slit 71 at the base of the crown that is aligned with the gap in the two brims. This slit 71 permits the movable brim to be installed in between the two fixed brims. After the movable brim is installed, the slit 71 can be sealed with a small adhesive strip 72 as shown (see FIG. 15).

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A cap having a movable visor comprising:

a) a crown;

b) an upper brim, being generally rectangular and having a front, a back and two oppositely disposed sides, said upper brim being fixedly attached to said crown and extending outwardly therefrom perpendicular to the crown:

c) a lower brim, being generally rectangular and having a front, a back, and two oppositely disposed sides, and being of the same general configuration as the upper brim, said lower brim being fixedly attached to said crown and extending outwardly therefrom perpendicular to the crown, said lower brim being positioned below said upper brim and also being connected to said upper brim at the sides of said brims, such that said upper brim and said lower brim form a pocket therebetween with the front of the pocket being open;

d) a movable brim, having two sides and being generally shaped the same as the upper and lower brims, but being sized slightly smaller to permit said movable brim to be placed inside the pocket formed by the upper and lower brims, such that said movable brim can be extended from said pocket or retracted into said pocket as desired;

e) a first ear, fixedly attached to one side of the movable brim and a second ear fixedly attached to the second side of said movable brim, said ears being oppositely disposed on said movable brim; and f) means to restrain said ears, said means being formed in the upper and lower brims, to prevent the movable brim from being completely removed from the pocket formed by the upper brim and the lower brim.

2. The cap of claim 1 wherein said crown is open, forming a sun visor.

3. The cap of claim 1 wherein said means to restrain said ears comprises a plurality of sewn stitches, placed through said upper brim and said lower brim in such a position to align with said ears on said movable brim, whereby said stitches engage said ears as the movable brim is extended, thereby preventing further outward movement of said movable brim.

4. The cap of claim 1 wherein said means to restrain said ears comprises two rivets, placed through said upper brim and said lower brim in such a position to align with said ears on said movable brim, whereby said rivets engage said ears as the movable brim is extended, thereby preventing further outward movement of said movable brim.

5. The method of construction of a cap having a movable visor comprising the steps of:

a) constructing a crown;

b) forming an upper brim, being generally rectangular and having a front, a back, and two oppositely disposed sides;

c) forming a lower brim, being generally rectangular and having a front, a back, and two oppositely disposed sides;

d) forming a movable brim, having two sides and being generally shaped the same as the upper and lower brims, but being sized slightly smaller to permit said movable brim to be placed in between said upper and lower brims, forming a first ear, fixedly attached to one side of the movable brim and a second ear fixedly attached to the second side of said movable brim, said ears being oppositely disposed on said movable brim;

e) placing the lower brim beneath the upper brim, and the movable brim in between said upper and lower brims;

f) placing a first line of stitches through one side of the upper and lower brims;

g) placing a second line of stitches through the other side of upper and lower brims, said second line of stitches being oppositely disposed to said first line of stitches;

h) placing a restraint means through said upper and lower brims, such that said restraint means is aligned with said ears, such that when said movable brim is extended, said ears contact said restraint means, thereby preventing further forward movement of said movable brim;

i) attaching said brims to said crown.

6. The method of claim 5 wherein said crown is open to act as a sun visor.

7. The method of claim 5 wherein said restraint means are two rows of additional stitches, placed through said upper and lower brims and being aligned with said ears such that when said movable brim is extended, said ears contact said stitches, thereby preventing further forward movement of said movable brim.

8. The method of claim 5 wherein said restraint means are two rivets, placed through said upper and lower brims and being aligned with said ears such that when said movable brim is extended, said ears contact said rivets, thereby preventing further forward movement of said movable brim.

9. The method of construction of a cap having a movable visor comprising the steps of:

a) constructing a crown;

b) forming an upper brim, being generally rectangular and having a front, a back, and two oppositely disposed sides;

c) forming a lower brim, being generally rectangular and having a front, a back, and two oppositely disposed sides;

d) forming a movable brim, having two sides and being generally shaped the same as the upper and lower brims, but being size slightly smaller to permit said movable brim to be placed in between said upper and lower brims, forming a first ear, fixedly attached to one side of the movable brim and a second ear fixedly attached to the second side of said movable brim, said ears being oppositely disposed on said movable brim;

e) placing the lower brim beneath the upper brim, and the movable brim in between said upper and lower brims, thereby forming a brim assembly;

f) placing the brim assembly into a jig, which holds the brim assembly in proper position for joining;

g) moving a sewing machine head, into position above said jig;

h) placing a first line of stitches through one side of the upper and lower brims;

i) placing a second line of stitches through the other side of upper and lower brims, said second line of stitches being oppositely disposed to said first line of stitches;

h) placing a restraint means through said upper and lower brims, such that said restraint means is aligned with said ears, such that when said movable brim is extended, said ears contact said restraint means, thereby preventing further forward movement of said movable brim;

i) attaching said brims to said crown.

10. The method of claim 9 wherein said restraint means are two rows of additional stitches, placed through said upper and lower brims and being aligned with said ears such that when said movable brim is extended, said ears contact said stitches, thereby preventing further forward movement of said movable brim.

11. The method of claim 5 wherein said restraint means are two rivets, placed through said upper and lower brims and being aligned with said ears such that when said movable brim is extended, said ears contact said rivets, thereby preventing further forward movement of said movable brim.

12. The method of claim 9 wherein said jig further comprises a switch that engages the sewing machine head into operation when said brim assembly is placed into position onto said jig.

13. The method of claim 9 wherein said sewing machine head is fitted with a riveter that places a rivet through said brim assembly when said riveter is engaged.

* * * * *